US010171917B2

(12) United States Patent
Wu et al.

(10) Patent No.: US 10,171,917 B2
(45) Date of Patent: Jan. 1, 2019

(54) LATERAL MODE CAPACITIVE MICROPHONE

(71) Applicants: Guanghua Wu, Dublin, CA (US); Xingshuo Lan, San Jose, CA (US)

(72) Inventors: Guanghua Wu, Dublin, CA (US); Xingshuo Lan, San Jose, CA (US)

(73) Assignee: GMEMS Technologies International Limited, Milpitas, CA (US)

( * ) Notice: Subject to any disclaimer, the term of this patent is extended or adjusted under 35 U.S.C. 154(b) by 0 days.

(21) Appl. No.: 15/393,831

(22) Filed: Dec. 29, 2016

(65) Prior Publication Data

US 2018/0192205 A1 Jul. 5, 2018

(51) Int. Cl.
*H04R 19/04* (2006.01)
*H04R 7/18* (2006.01)

(52) U.S. Cl.
CPC ..... *H04R 19/04* (2013.01); *H04R 7/18* (2013.01); *H04R 2201/003* (2013.01); *H04R 2410/07* (2013.01)

(58) Field of Classification Search
CPC ..... H04R 19/04; H04R 19/005
See application file for complete search history.

(56) References Cited

U.S. PATENT DOCUMENTS

| | | | | |
|---|---|---|---|---|
| 7,545,945 | B2 * | 6/2009 | Miles | H04R 19/04 |
| 8,165,323 | B2 * | 4/2012 | Zhou | H01G 5/011 257/415 |
| 8,467,548 | B2 * | 6/2013 | Karunasiri | H04R 3/00 381/111 |
| 8,781,140 | B2 * | 7/2014 | Lautenschlager | H04R 19/005 381/174 |
| 8,783,113 | B2 * | 7/2014 | Robert | B81B 3/0021 73/700 |
| 9,510,121 | B2 * | 11/2016 | Xu | H04R 1/326 |
| 9,611,135 | B1 * | 4/2017 | Klein | B81B 3/0059 |
| 9,674,627 | B2 * | 6/2017 | Hsu | H04R 19/005 |
| 9,728,653 | B2 * | 8/2017 | Dehe | H04R 19/005 |
| 9,809,444 | B2 * | 11/2017 | Klein | B81B 3/0021 |

* cited by examiner

*Primary Examiner* — Curtis A Kuntz
*Assistant Examiner* — Ryan Robinson
(74) *Attorney, Agent, or Firm* — Guosheng Wang; United States Research and Patent Firm

(57) ABSTRACT

The present invention provides a capacitive microphone including a MEMS microphone. In the microphone, the movable or deflectable membrane/diaphragm moves in a lateral manner relative to the fixed backplate, instead of moving toward/from the fixed backplate. The squeeze film damping is substantially avoided, and the performances of the microphone is significantly improved.

16 Claims, 14 Drawing Sheets

Cross Section View

Top View

LATERAL MODE CAPACITIVE MICROPHONE

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

FIELD OF THE INVENTION

The present invention generally relates to a lateral mode capacitive microphone. The microphone of the invention may find applications in smart phones, telephones, hearing aids, public address systems for concert halls and public events, motion picture production, live and recorded audio engineering, two-way radios, megaphones, radio and television broadcasting, and in computers for recording voice, speech recognition, VoIP, and for non-acoustic purposes such as ultrasonic sensors or knock sensors, among others.

BACKGROUND OF THE INVENTION

A microphone is a transducer that converts sound into an electrical signal. Among different designs of microphone, a capacitive microphone or a condenser microphone is conventionally constructed employing the so-called "parallel-plate" capacitive design. Unlike other microphone types that require the sound wave to do more work, only a very small mass in capacitive microphones needs be moved by the incident sound wave. Capacitive microphones generally produce a high-quality audio signal and are now the popular choice in consumer electronics, laboratory and recording studio applications, ranging from telephone transmitters through inexpensive karaoke microphones to high-fidelity recording microphones.

FIG. 1 is a schematic diagram of parallel capacitive microphone in the prior art. Two thin layers 101 and 102 are placed closely in almost parallel. One of them is fixed backplate 101, and the other one is movable/deflectable membrane/diaphragm 102, which can be moved or driven by sound pressure. Diaphragm 102 acts as one plate of a capacitor, and the vibrations thereof produce changes in the distance between two layers 101 and 102, and changes in the mutual capacitance therebetween.

"Squeeze film" and "squeezed film" refer to a type of hydraulic or pneumatic damper for damping vibratory motion of a moving component with respect to a fixed component. Squeezed film damping occurs when the moving component is moving perpendicular and in close proximity to the surface of the fixed component (e.g., between approximately 2 and 50 micrometers). The squeezed film effect results from compressing and expanding the fluid (e.g., a gas or liquid) trapped in the space between the moving plate and the solid surface. The fluid has a high resistance, and damps the motion of the moving component as the fluid flows through the space between the moving plate and the solid surface.

In capacitive microphones as shown in FIG. 1, squeeze film damping occurs when two layers 101 and 102 are in close proximity to each other with air disposed between them. The layers 101 and 102 are positioned so close together (e.g. within 5 μm) that air can be "squeezed" and "stretched" to slow movement of membrane/diaphragm 101. As the gap between layers 101 and 102 shrinks, air must flow out of that region. The flow viscosity of air, therefore, gives rise to a force that resists the motion of moving membrane/diaphragm 101. Squeeze film damping is significant when membrane/diaphragm 101 has a large surface area to gap length ratio. Such squeeze film damping between the two layers 101 and 102 becomes a mechanical noise source, which is the dominating factor among all noise sources in the entire microphone structure.

Advantageously, the present invention provides a microphone design in which the squeeze film damping is substantially avoided because the movable membrane/diaphragm does not move into the fixed backplate.

SUMMARY OF THE INVENTION

The present invention provides a capacitive microphone comprising a first electrical conductor and a second electrical conductor. The two conductors are configured to have a relative spatial relationship therebetween so that a mutual capacitance can be generated between them. The relative spatial relationship as well as the mutual capacitance can both be varied by an acoustic pressure impacting upon the first electrical conductor and/or the second electrical conductor along a range of impacting directions in 3D space. Given the same strength/intensity of acoustic pressure, the mutual capacitance can be varied the most (or maximally varied) by an acoustic pressure impacting upon the first electrical conductor and/or the second electrical conductor along one direction among the above range of impacting directions. Such a direction is defined as the primary direction. The first electrical conductor has a first projection along the primary direction on a conceptual plane that is perpendicular to the primary direction. The second electrical conductor has a second projection along the primary direction on the conceptual plane. The first projection and the second projection have a shortest distance Dmin therebetween, and Dmin remains greater than zero regardless the first electrical conductor and/or the second electrical conductor is (are) impacted by an acoustic pressure along the primary direction or not.

The above features and advantages and other features and advantages of the present invention are readily apparent from the following detailed description of the best modes for carrying out the invention when taken in connection with the accompanying drawings.

BRIEF DESCRIPTION OF THE SEVERAL VIEWS OF THE DRAWINGS

The present invention is illustrated by way of example, and not by way of limitation, in the figures of the accompanying drawings and in which like reference numerals refer to similar elements. All the figures are schematic and generally only show parts which are necessary in order to elucidate the invention. For simplicity and clarity of illustration, elements shown in the figures and discussed below have not necessarily been drawn to scale. Well-known structures and devices are shown in simplified form in order to avoid unnecessarily obscuring the present invention. Other parts may be omitted or merely suggested.

DETAILED DESCRIPTION OF THE PREFERRED EMBODIMENT

In the following description, for the purposes of explanation, numerous specific details are set forth in order to provide a thorough understanding of the present invention. It is apparent, however, to one skilled in the art that the present invention may be practiced without these specific details or with an equivalent arrangement.

Where a numerical range is disclosed herein, unless otherwise specified, such range is continuous, inclusive of both the minimum and maximum values of the range as well as every value between such minimum and maximum values. Still further, where a range refers to integers, only the integers from the minimum value to and including the maximum value of such range are included. In addition, where multiple ranges are provided to describe a feature or characteristic, such ranges can be combined.

Figure 2A:
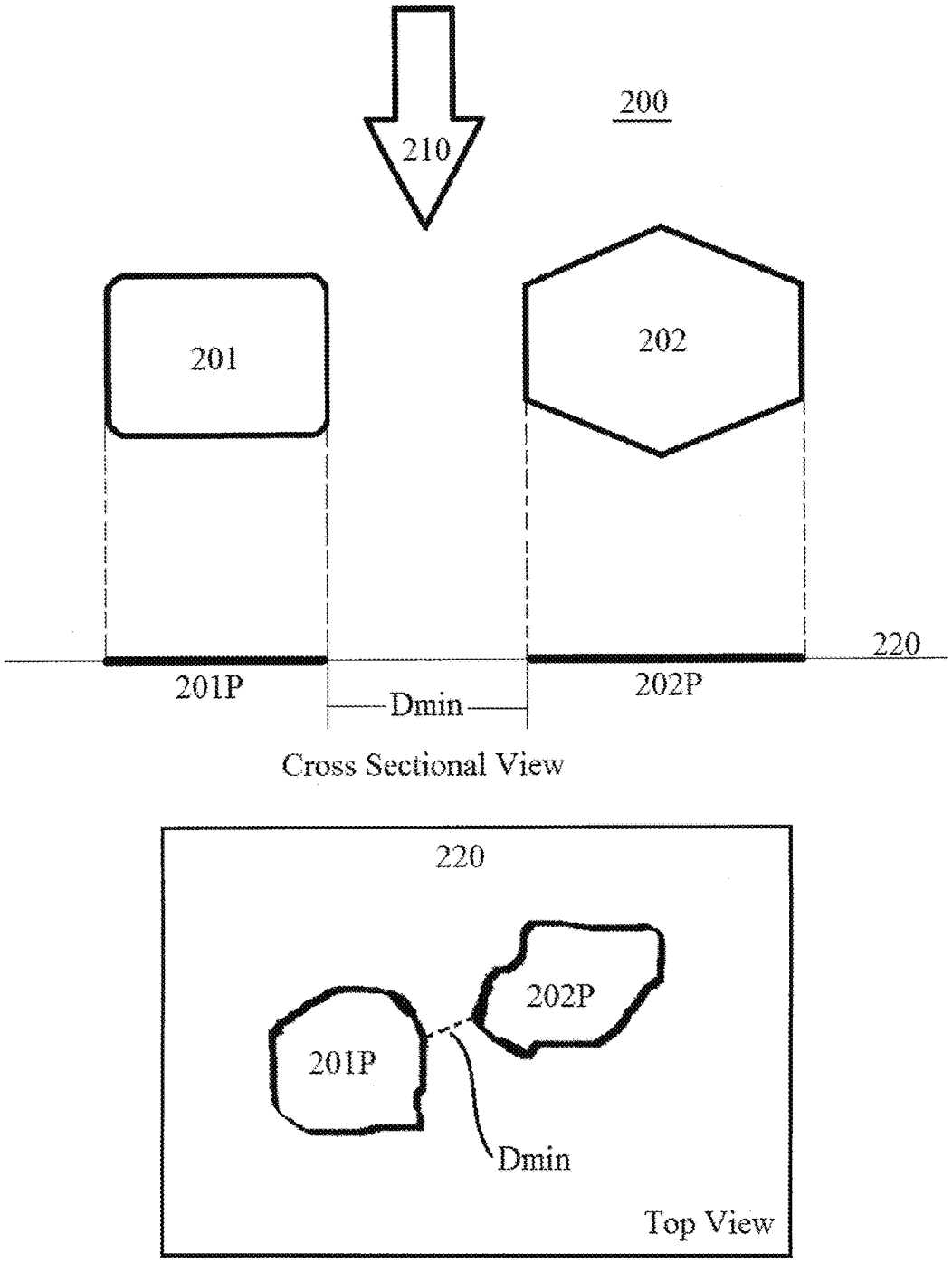
FIG. 2A schematically shows a lateral mode capacitive microphone in accordance with an exemplary embodiment of the present invention.
Figure 3:
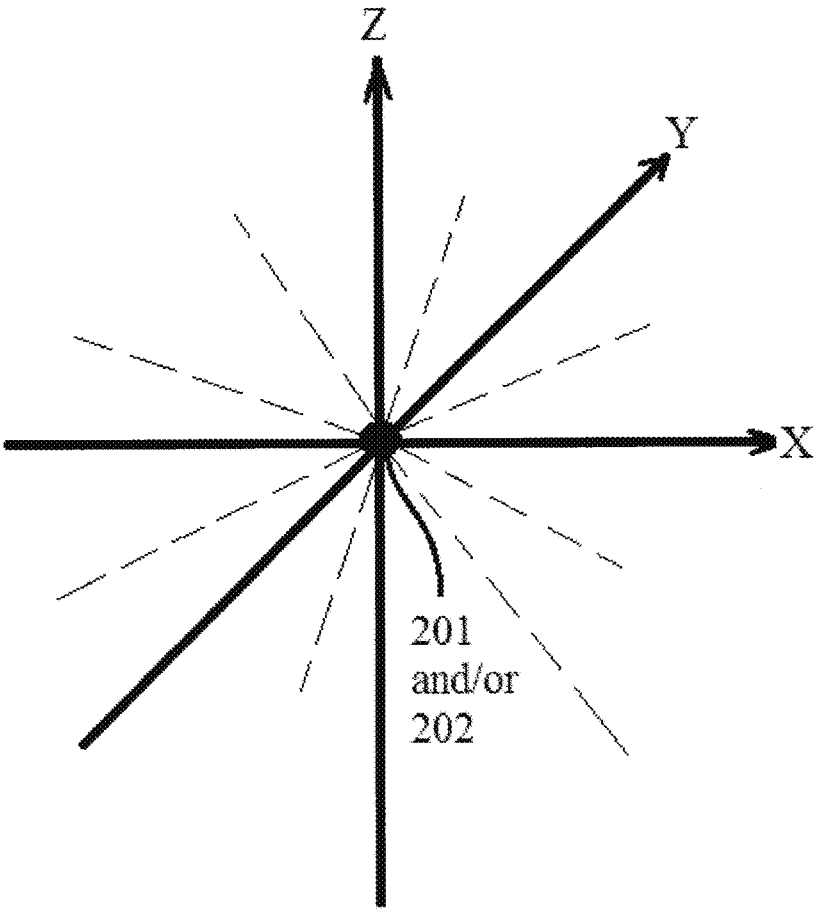
FIG. 3 illustrates acoustic pressures impacting a microphone along a range of directions.
Figure 4:
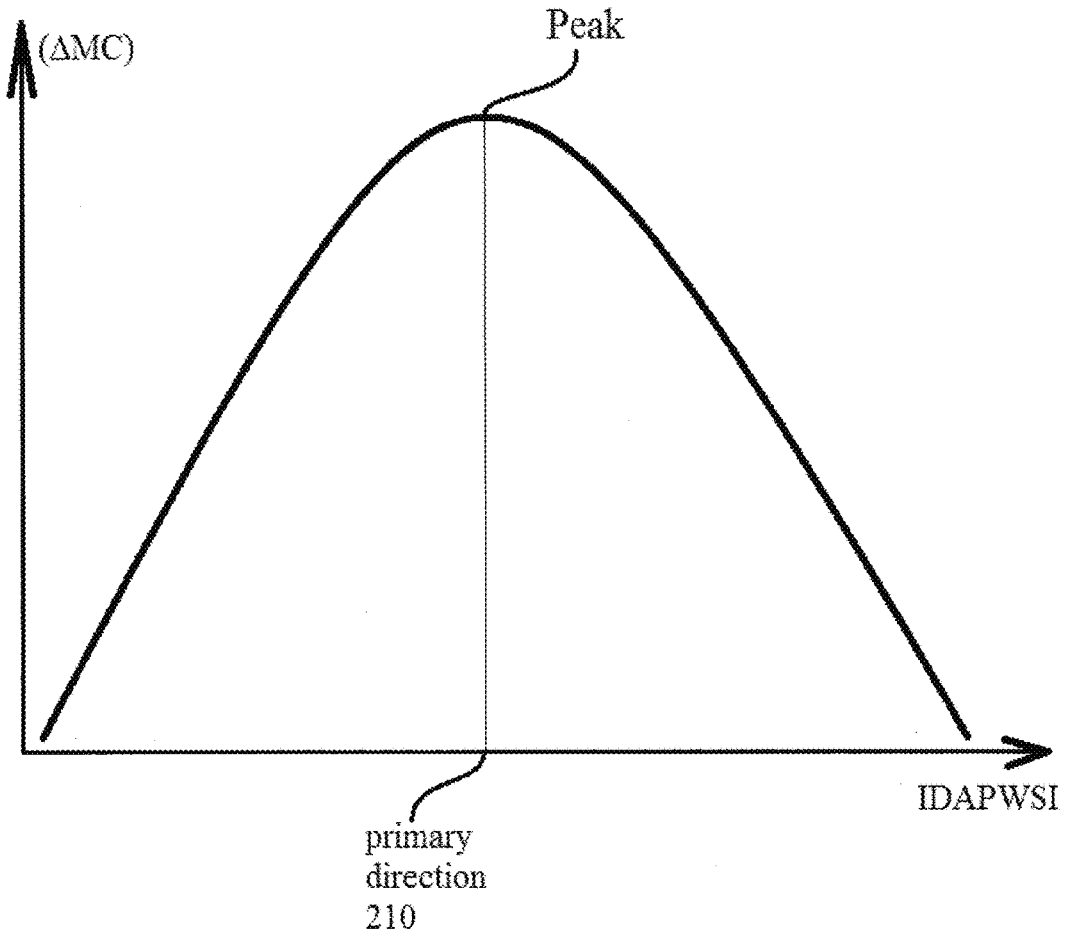
FIG. 4 illustrates the methodology on how to determine the primary direction for the internal components in a microphone in accordance with an exemplary embodiment of the present invention.

FIG. 2A illustrates a capacitive microphone 200 such as a MEMS microphone according to various embodiments of the invention. A first electrical conductor 201 and a second electrical conductor 202 are configured to have a relative spatial relationship therebetween so that a mutual capacitance can be generated between them. The first electrical conductor 201 and the second electrical conductor 202 are independently of each other made of polysilicon, gold, silver, nickel, aluminum, copper, chromium, titanium, tungsten, and platinum. The relative spatial relationship as well as the mutual capacitance can both be varied by an acoustic pressure impacting upon the first electrical conductor 201 and/or the second electrical conductor 202. As shown in FIG. 3, the acoustic pressure may impact 201 and/or 202 along a range of impacting directions in 3D space as represented by dotted lines. Given the same strength/intensity of acoustic pressure, the mutual capacitance can be varied the most (or maximally varied) by an acoustic pressure impacting upon the first electrical conductor 201 and/or the second electrical conductor 202 along a certain direction among the above range of impacting directions as shown in FIG. 3. The variation of mutual capacitance (ΔMC) caused by various impacting directions of acoustic pressure from 3D space with same intensity (IDAPWSI) is conceptually plotted in FIG. 4. A primary direction is defined as the impacting direction that generates the peak value of ΔMC, and is labeled as direction 210 in FIG. 2A. It should be appreciated that, given the same strength/intensity of acoustic pressure, the relative spatial relationship can be varied the most (or maximally varied) by an acoustic pressure impacting upon the first electrical conductor 201 and/or the second electrical conductor 202 along a certain direction X among the range of impacting directions as shown in FIG. 3. Direction X may be the same as, or different from, the primary direction 210 as defined above. In some embodiments of the invention, the primary direction may be alternatively defined as the direction X.

Figure 1:
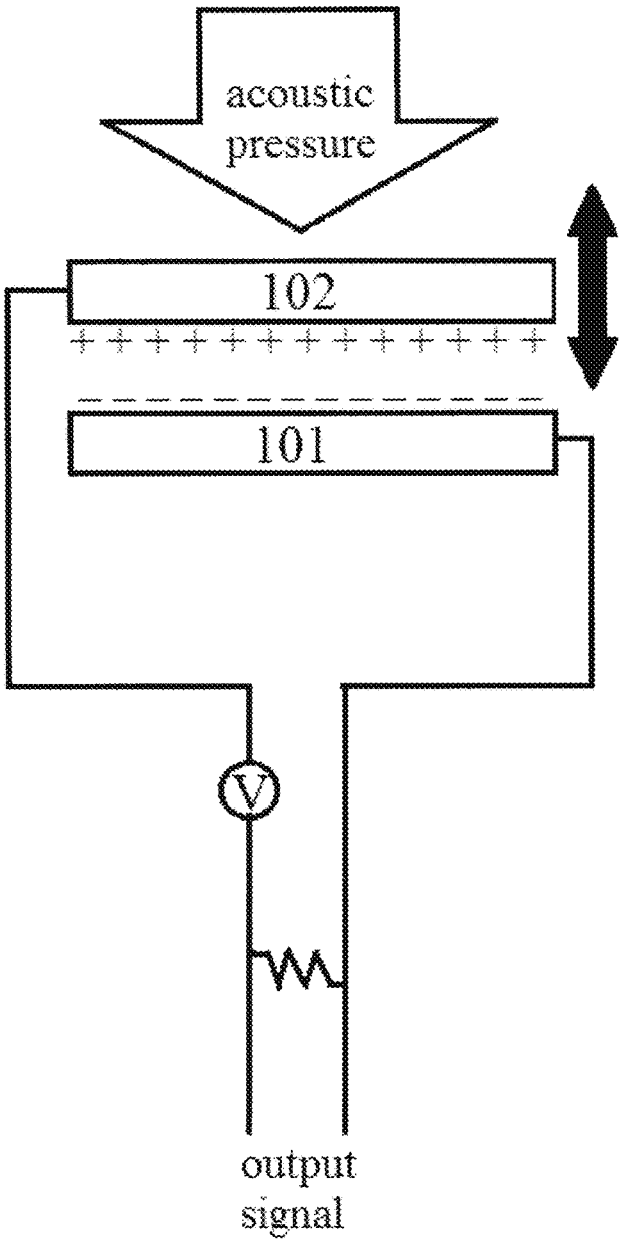
(Prior Art) Figure 1
FIG. 1 shows a conventional capacitive microphone in the prior art.
Figure 2B:
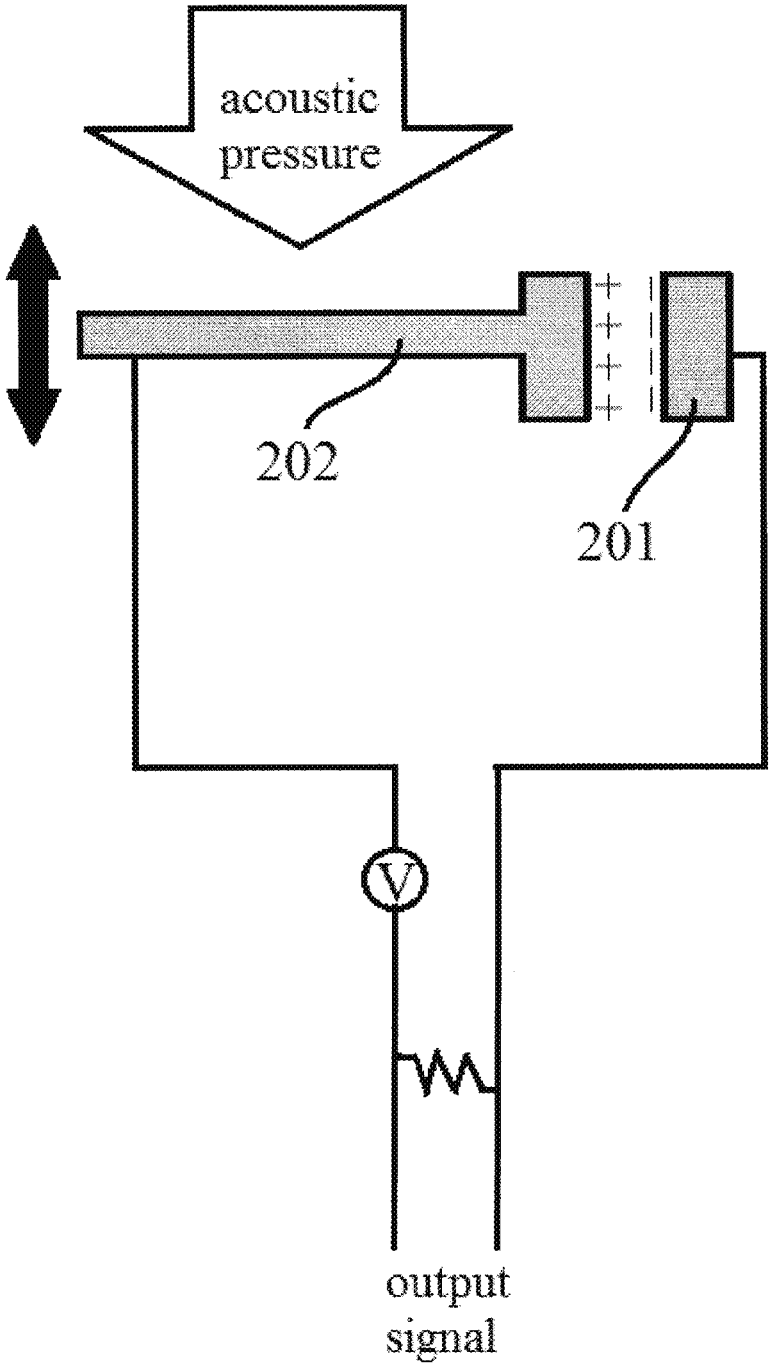
FIG. 2B illustrates a lateral mode capacitive microphone in accordance with an exemplary embodiment of the present invention.

Referring back to FIG. 2A, the first electrical conductor 201 has a first projection 201P along the primary direction 210 on a conceptual plane 220 that is perpendicular to the primary direction 210. The second electrical conductor 202 has a second projection 202P along the primary direction 210 on the conceptual plan 220*e*. The first projection 201P and the second projection 202P have a shortest distance Dmin therebetween. In the present invention, Dmin may be constant or variable, but it is always greater than zero, no matter the first electrical conductor 201 and/or the second electrical conductor 202 is (are) impacted by an acoustic pressure along the primary direction 210 or not. FIG. 2B illustrates an exemplary embodiment of the microphone of FIG. 2A. First electrical conductor 201 is stationary, and has a function similar to the fixed backplate in the prior art. A large flat area of second electrical conductor 202, similar to movable/deflectable membrane/diaphragm 102 in FIG. 1, receives acoustic pressure and moves up and down along the primary direction, which is perpendicular to the flat area. However, conductors 201 and 202 are configured in a side-by-side spatial relationship. As one "plate" of the capacitor, second electrical conductor 202 does not move toward and from first conductor 201. Instead, second conductor 202 laterally moves over, or "glides" over, first conductor 201, producing changes in the overlapped area between 201 and 202, and therefore varying the mutual capacitance therebetween. A capacitive microphone based on such a relative movement between conductors 201 and 202 is called lateral mode capacitive microphone in the present invention.

In exemplary embodiments of the invention, the microphone may be a MEMS (Microelectromechanical System) microphone, AKA chip/silicon microphone. Typically, a pressure-sensitive diaphragm is etched directly into a silicon wafer by MEMS processing techniques, and is usually accompanied with integrated preamplifier. For a digital MEMS microphone, it may include built in analog-to-digital converter (ADC) circuits on the same CMOS chip making the chip a digital microphone and so more readily integrated with digital products.

Figure 5:
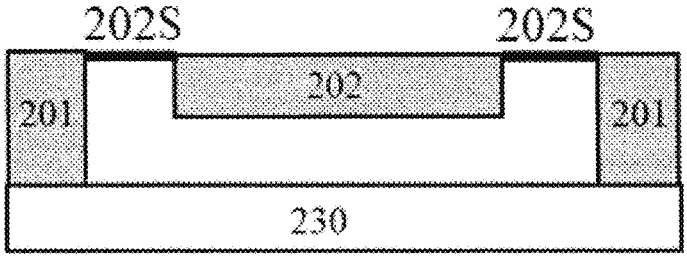
FIG. 5 schematically shows a MEMS capacitive microphone in accordance with an exemplary embodiment of the present invention.
Figure 5:
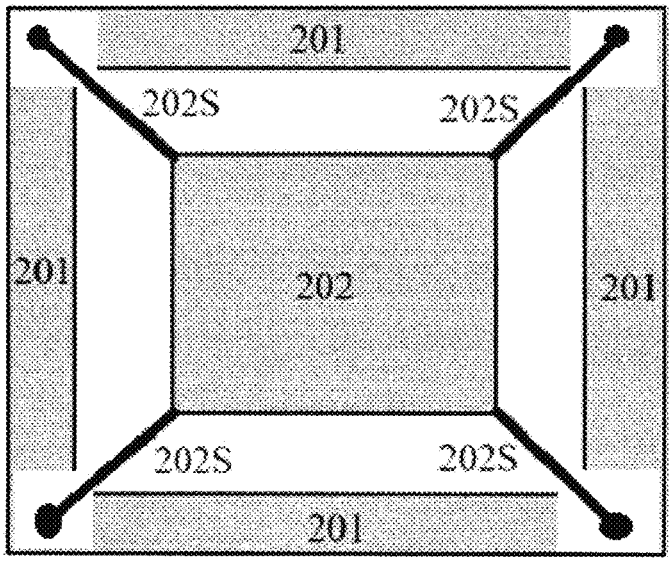

In an embodiment as shown in FIG. 5, capacitive microphone 200 may include a substrate 230 such as silicon. The substrate 230 can be viewed as the conceptual plane 220 in FIG. 2A. The first electrical conductor 201 and the second electrical conductor 202 may be constructed above the substrate 230 side-by-side. Alternatively, first electrical conductor 201 may be surrounding the second electrical conductor 202, as shown in FIG. 5. In an exemplary embodiment, first electrical conductor 201 is fixed relative to the substrate 230. On the other hand, second electrical conductor 202 may be a membrane that is movable relative to the substrate 230. The primary direction may be (is) perpendicular to the membrane plane 202. The movable membrane 202 may be attached to the substrate 230 via three or more suspensions 202S such as four suspensions 202S. As will be described and illustrated later, each of the suspension 202S may comprise folded and symmetrical cantilevers.

Figure 6:
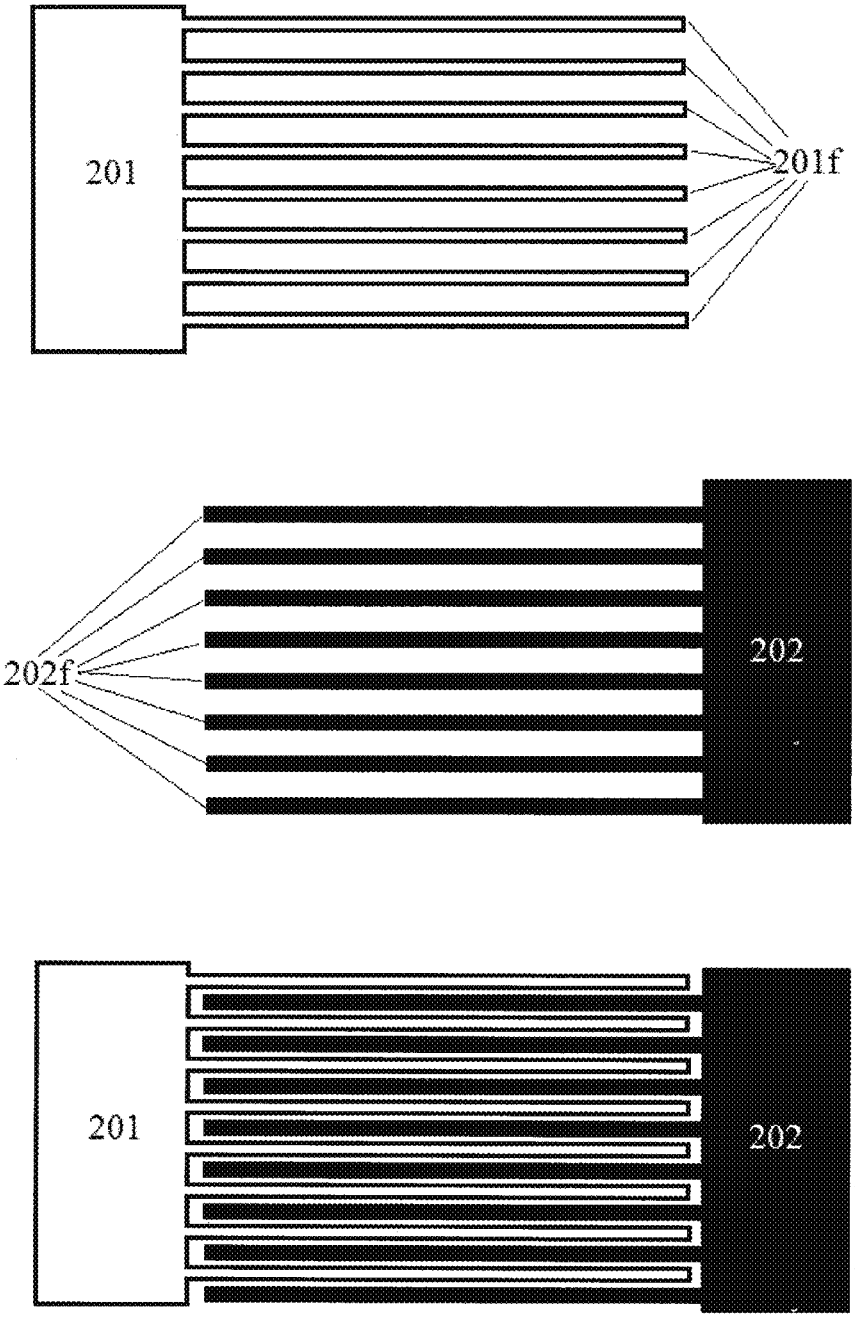
FIG. 6 illustrates the first/second electrical conductors having a comb finger configuration in accordance with an exemplary embodiment of the present invention.
Figure 7:
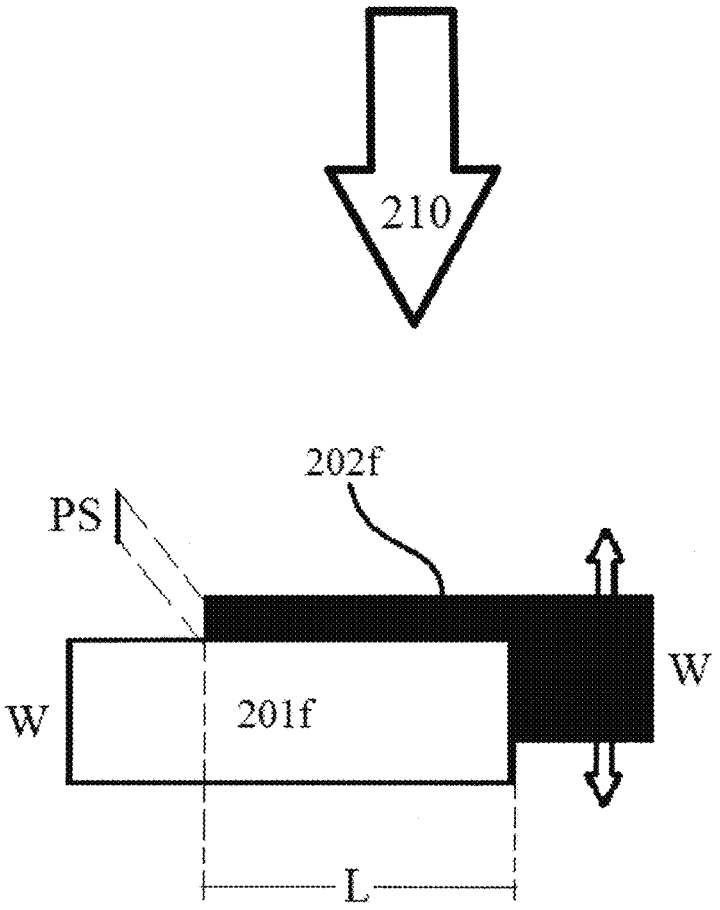
FIG. 7 depicts the spatial relationship between two comb fingers of FIG. 6 in accordance with an exemplary embodiment of the present invention.

In an embodiment as shown in FIG. 6, the first electrical conductor 201 comprises a first set of comb fingers 201*f*. The movable membrane as second conductor 202 comprises a second set of comb fingers 202*f* around the peripheral region of the membrane. The two sets of comb fingers 201*f* and 202*f* are interleaved into each other. The second set of comb fingers 202*f* are movable along the primary direction, which is perpendicular to the membrane plane 202, relative to the first set of comb fingers 201*f*. As such, the resistance from air located within the gap between the membrane 202 and the substrate is lowered, for example, 25 times lower squeeze film damping. In a preferred embodiment, the first set of comb fingers 201*f* and the second set of comb fingers 202*f* have identical shape and dimension. As shown in FIG. 7, each comb finger has a same width W measured along the primary direction 210, and the first set of comb fingers 201*f* and the second set of comb fingers 202*f* have a positional shift PS along the primary direction 210, in the absence of vibration caused by sound wave. For example, the positional shift PS along the primary direction 210 may be one third of the width W, PS=⅓ W. In other words, the first set of comb fingers 201*f* and the second set of comb fingers 202*f* have an overlap of ⅔W along the primary direction 210, in the absence of vibration caused by sound wave.

Figure 8:
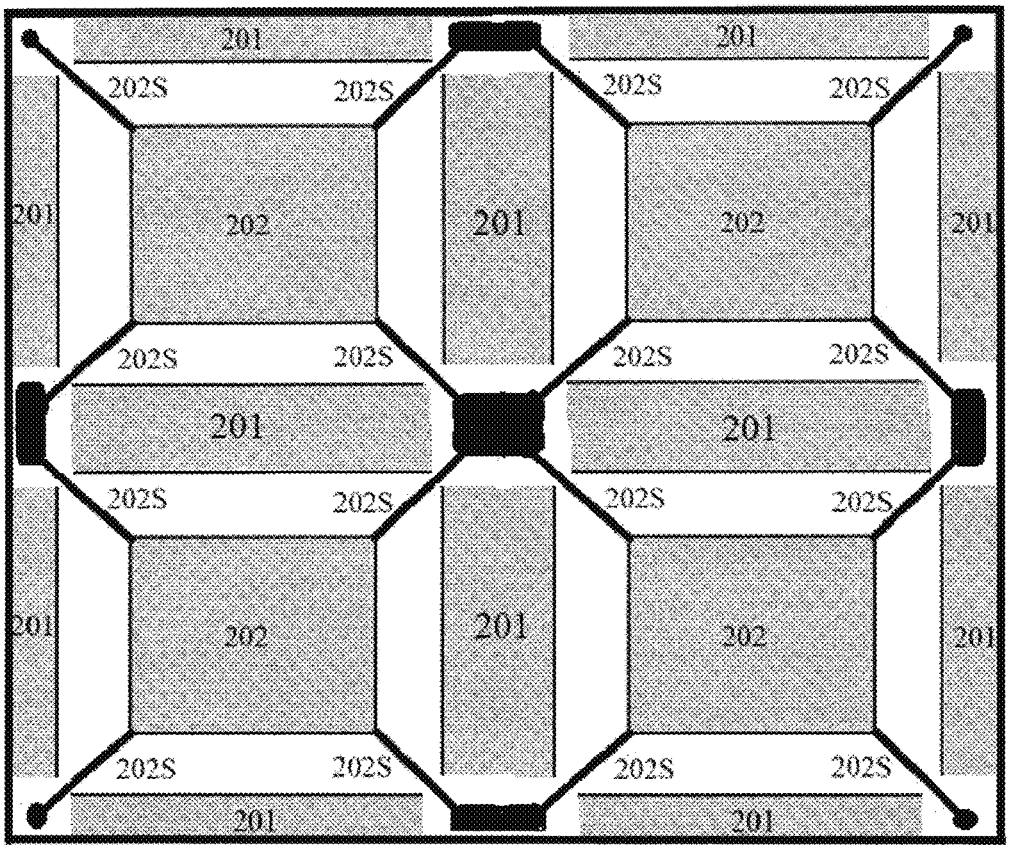
FIG. 8 shows that four movable membranes are arranged in a 2×2 array configuration in accordance with an exemplary embodiment of the present invention.

In embodiments, the movable membrane 202 may have a shape of square. As shown in FIG. 8, the capacitive microphone of the invention may include one or more movable membranes. For example, four movable membranes can be arranged in a 2×2 array configuration.

Figure 9:
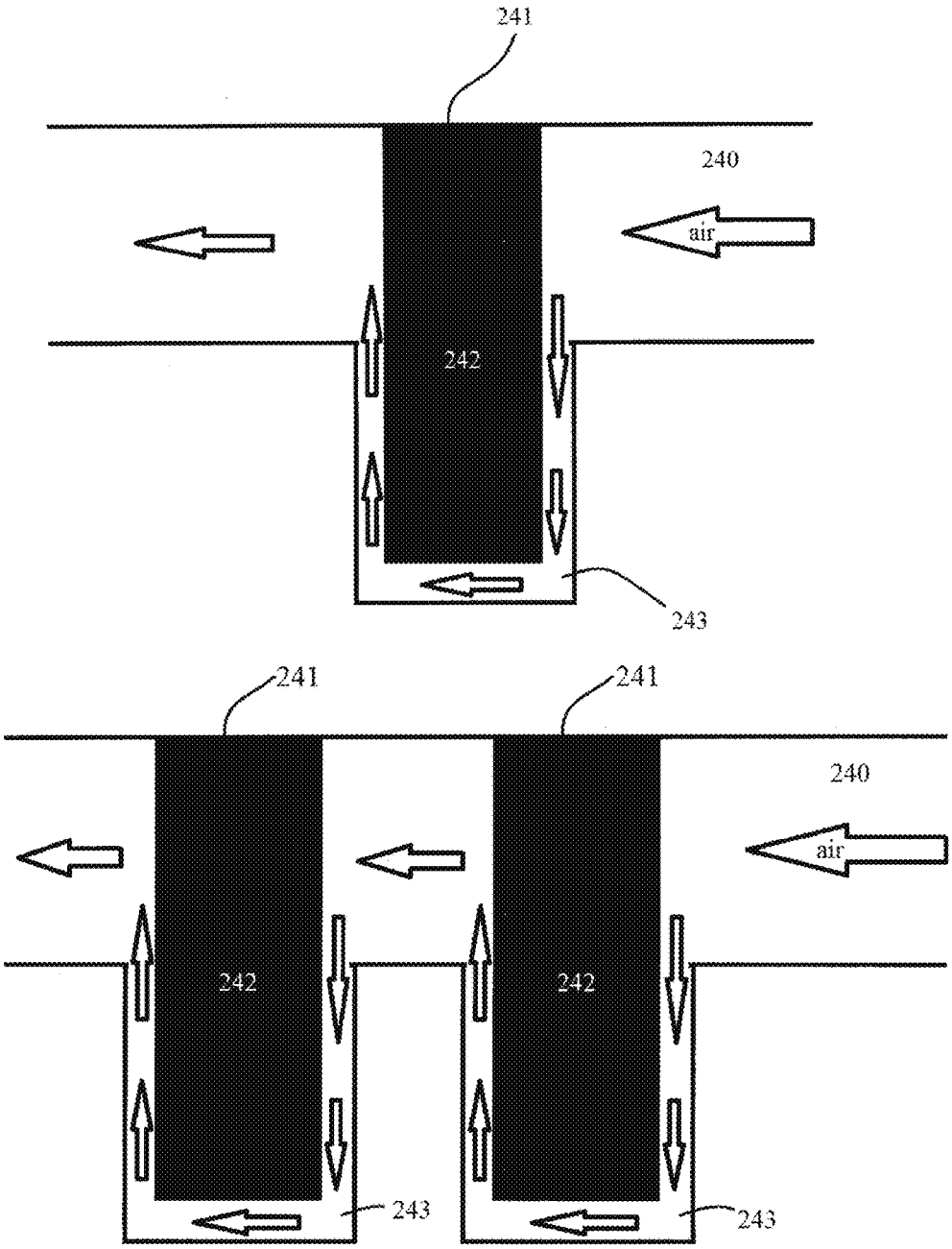
FIG. 9 demonstrates the design of one or more such as two air flow restrictors in accordance with an exemplary embodiment of the present invention.

In some embodiments as shown in FIG. 9, the capacitive microphone of the invention comprises one or more such as two air flow restrictors 241 that restrict the flow rate of air that flows in/out of the gap between the membrane 202 and the substrate 230. Air flow restrictors 241 may be designed to decrease the size of an air channel 240 for the air to flow in/out of the gap. Alternatively or additionally; air flow restrictors 241 may increase the length of the air channel 240 for the air to flow in/out of the gap. For example, air flow restrictors 241 may comprise an insert 242 into a groove 243, which not only decreases the size of an air channel 240, but also increases the length of the air channel 240.

Referring back to FIGS. 6 and 7, comb fingers 201*f* are fixed on anchor, and comb fingers 202*f* are integrated with membrane-shaped second electrical conductor 202 (hereinafter membrane 202 for simplicity). When membrane 202 vibrates due to sound wave, fingers 202*f* move together with membrane 202. The overlap area between two neighboring fingers 201*f* and 202*f* changes along with this movement, so does the capacitance. Eventually a capacitance change signal is detected that is the same as conventional capacitive microphone.

Figure 10:
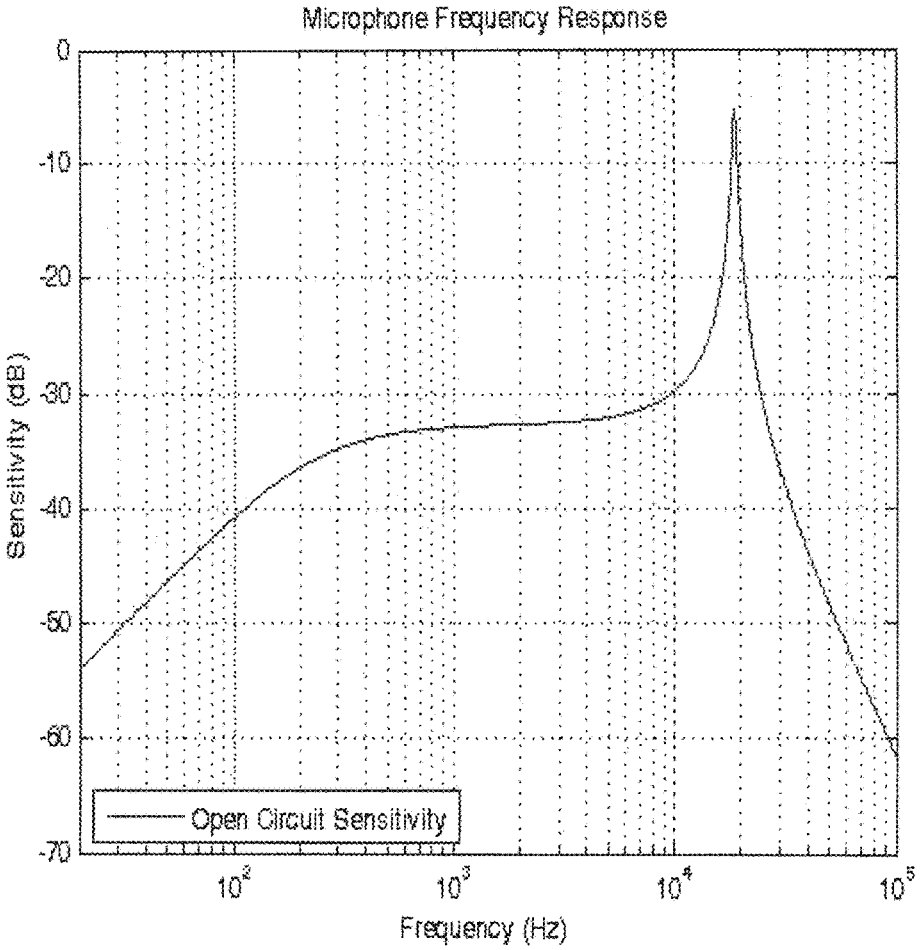
FIG. 10 shows that microphone sensitivity drops at low frequency due to air leakage.

Leakage is always a critical issue in microphone design. In conventional parallel plate design as shown in FIG. 1, it typically has a couple of tiny holes around the edge in order to let air go through slowly, to keep air pressure balance on both sides of membrane 101 in low frequency. That is a desired leakage. However, a large leakage is undesired, because it will let some low frequency sound wave escape away from membrane vibration easily via the holes, and will result in a sensitivity drop in low frequency. FIG. 10 shows that sensitivity drops at low frequency due to leakage. For a typical capacitive MEMS microphone, the frequency range is between 100 Hz and 20 kHz, thus the sensitivity drop in FIG. 10 is undesired.

Figure 11:
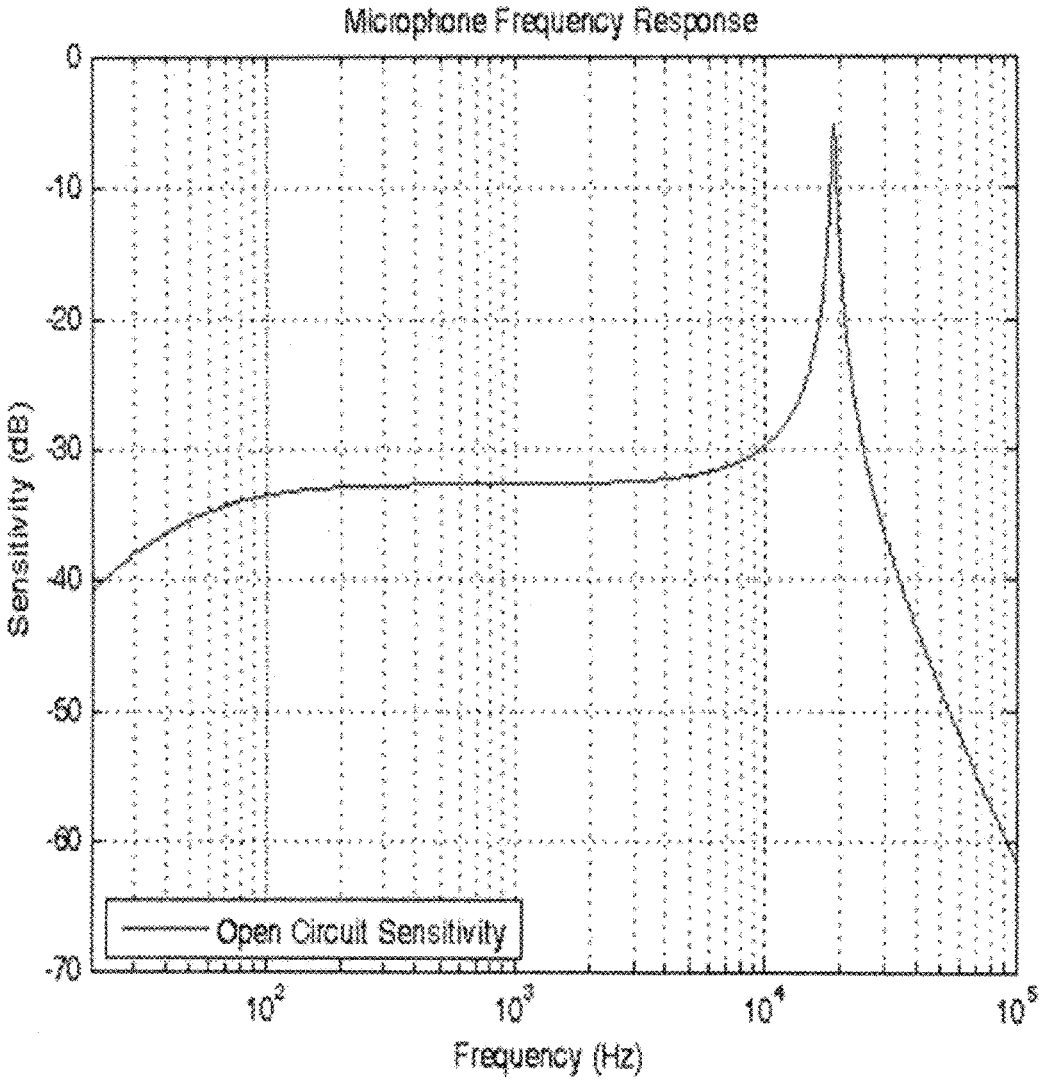
FIG. 11 shows the frequency response with air leakage reduced/prevented in accordance with an exemplary embodiment of the present invention.

In order to prevent this large leakage, a more preferred structure is designed and shown in FIG. 9, which illustrates a leakage prevent groove or slot and wall. Referring back to FIG. 9, air flow restrictors 241 may function as a structure for preventing air leakage in the microphone of the invention. Air flow restrictor 241 comprises an insert 242 into a groove 243, which not only decreases the size of an air channel 240, but also increases the length of the air channel 240. In MEMS microphones, a deep slot may be etched on substrate around the edge of square membrane 202 and then a wall 242 connected to membrane 202 is deposited to form a long and narrow air tube 240, which gives a large acoustic resistance. FIG. 11 depicts the frequency response with leakage prevented. This leakage prevention structure has a significant effect on keeping the frequency response plot more flat on the range 100 Hz to 1000 Hz. The level of the air resistance may be controlled by the slot depth etched on the substrate. The deeper slot, the higher the resistance.

In the following, a preferred embodiment of the invention will be analyzed using some theories and modeling. However, it should be understood that the present invention is not limited or bound by any particular theory and modeling.

The pressure noise $N_p$ can be defined as $$N_p = \frac{\sqrt{4k_T R_a}}{A_m} \tag{1}$$

in which $k_T$ is Boltzmann Constant at 300 k ($1.38\times10^{-23}$ J/K*300K), $R_a$ is the acoustic resistance in the whole system, and $A_m$ is the area of membrane.

Sensitivity and Signal-to-Noise Ratio (SNR) are two factors that are most important to describe the performance of a microphone. As standard calculation, 20 μPa sound pressure is marked as 1 sound unit or as 0 dB.

$$\text{Sound Level in dB}=20\log(\text{sound unit}) \tag{2}$$

When there is just 1 sound unit, the Sound Level in dB will be zero. But if there are 50,000 sound units which is 1 Pa equivalent sound pressure, the Sound Level in dB will be 94 dB. Equivalent Noise Level (ENL) is often used to represent the noise level under 1 Pa. Thus the SNR can be derived as:

$$SNR = \frac{\text{1 Pa (Signal)}}{\text{Noise Under 1 Pa (Noise)}} = 94\text{ dB} - ENL \tag{3}$$

The performances of an embodiment of the lateral mode microphone according to the present invention are evaluated, estimated, and listed in Table 1. Due to a much smaller squeeze film damping, the equivalent noise level (ENL) of a single membrane may be reduced by 4 dB. In addition, the 4-die array may reduce noise by 2 times (i.e. 6 dB) as well. Therefore, the eventual SNR may have a 10 dB improvement.

TABLE 1

Comparison between New Lateral Microphone of the Invention (New mic) and Conventional Parallel-Plate Microphone (Original mic)

| | New mic | Original mic |
|---|---|---|
| Sensitivity (dB)/4-die array | −33 dB/−21 dB | −48 dB |
| SNR/4-die array | 71 dB/77 dB | 67 dB |

Figure 12:
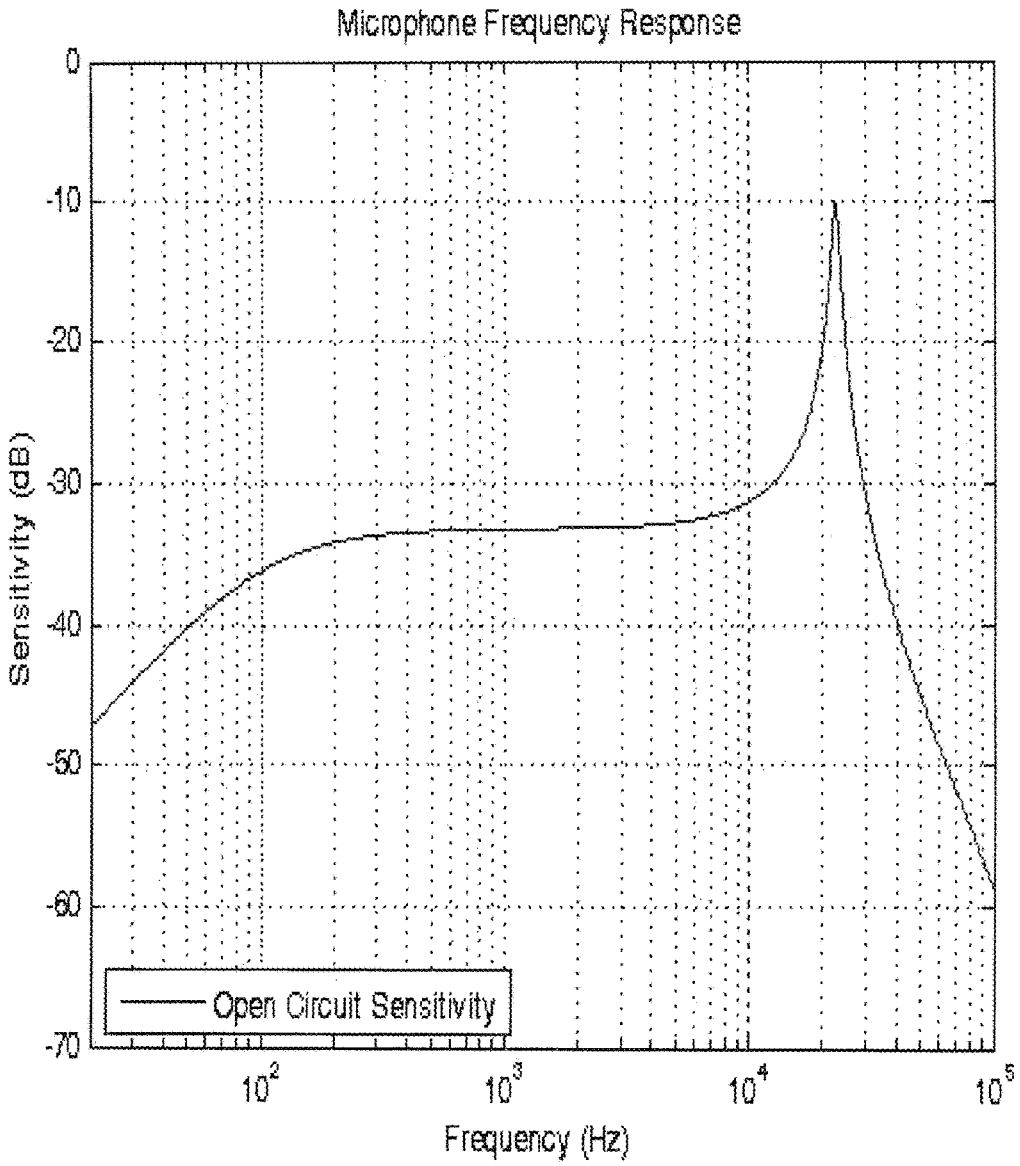
FIG. 12 demonstrates the frequency response of a lateral mode mic (microphone) design in accordance with an exemplary embodiment of the present invention.
Figure 13:
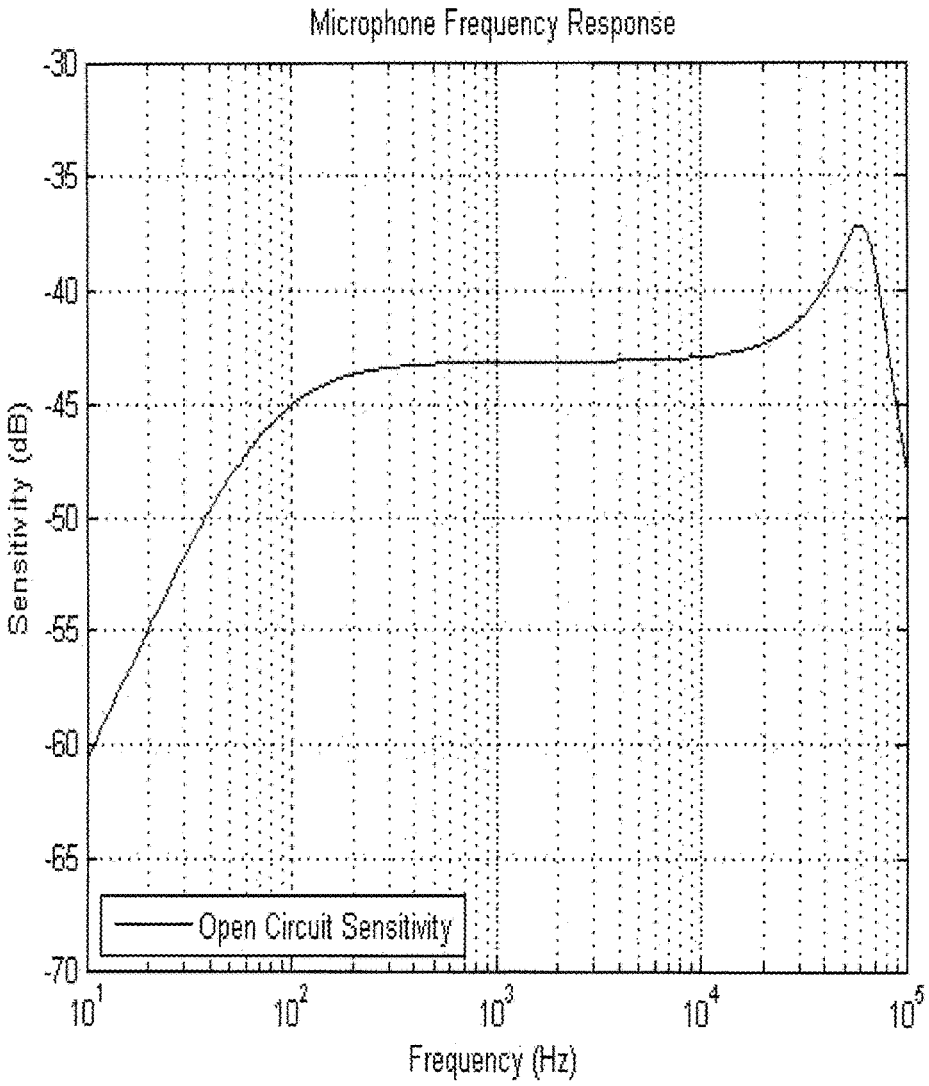
FIG. 13 shows the frequency response of a conventional mic design for comparison.

As for the comparison of frequency response, lateral mode design has a higher Q factor due to lower damping, as shown in FIG. 12. However, at the same time, it also has a larger sensitivity range from 10 kHz to 100 Hz, since the leakage level is still not low enough. For comparison, FIG. 13 demonstrates the frequency response for the original mic design.

In order to have more flat frequency response curve, either deeper leakage prevent slot and wall, or even double slots can be introduced in the microphone structure. The design can be modified by adding one more slot/groove. As illustrated in the lower diagram of FIG. 9, such double slots can improve the performance significantly, as demonstrated in Table 2.

TABLE 2

The performance of double-slot leakage prevent design

| | |
|---|---|
| Sensitivity @ 1 kHz/4 die array | −34.9 dB/−22.9 dB |
| SNR | 70.8 dB/76.8 dB |

In the foregoing specification, embodiments of the present invention have been described with reference to numerous specific details that may vary from implementation to implementation. The specification and drawings are, accordingly, to be regarded in an illustrative rather than a restrictive sense. The sole and exclusive indicator of the scope of the invention, and what is intended by the applicant to be the scope of the invention, is the literal and equivalent scope of the set of claims that issue from this application, in the specific form in which such claims issue, including any subsequent correction.

The invention claimed is:

1. A capacitive microphone comprising a first electrical conductor and a second electrical conductor configured to have a relative spatial relationship therebetween, wherein a mutual capacitance can be generated between the first electrical conductor and the second electrical conductor;

wherein said relative spatial relationship and said mutual capacitance can both be varied by an acoustic pressure impacting upon the first electrical conductor and/or the second electrical conductor along a range of impacting directions in 3D space;

wherein said mutual capacitance is varied the most by an acoustic pressure impacting upon the first electrical conductor and/or the second electrical conductor along one direction among said range of impacting directions, said one direction being defined as the primary direction;

wherein the first electrical conductor has a first projection along said primary direction on a conceptual plane that is perpendicular to said primary direction;

wherein the second electrical conductor has a second projection along said primary direction on the conceptual plane;

wherein the first projection and the second projection have a shortest distance Dmin therebetween, and Dmin remains greater than zero regardless of whether the first electrical conductor and/or the second electrical conductor is (are) impacted by an acoustic pressure along said primary direction or not;

wherein the second electrical conductor, as one plate of a capacitor, moves up and down along the primary direction, and laterally moves over, or glides over, the first electrical conductor along the primary direction, wherein the capacitive microphone further comprises a substrate, the substrate is viewed as said conceptual plane, and the first electrical conductor and the second electrical conductor are constructed above the substrate side-by-side;

wherein the first electrical conductor is fixed relative to the substrate, the second electrical conductor comprises a membrane that is movable relative to the substrate, and said primary direction is perpendicular to the membrane plane; and wherein the capacitive microphone further comprises an air flow restrictor that restricts the flow rate of air that flows in/out of the gap between the membrane and the substrate, and the air flow restrictor comprises a groove and an insert that can insert into the groove.

2. The capacitive microphone according to claim 1, wherein the first electrical conductor and the second electrical conductor are independent of each other, and made of polysilicon, gold, silver, nickel, aluminum, copper, chromium, titanium, tungsten, or platinum.

3. The capacitive microphone according to claim 2, which is a MEMS microphone.

4. The capacitive microphone according to claim 1, wherein the movable membrane is attached to the substrate via three or more suspensions such as four suspensions.

5. The capacitive microphone according to claim 4, wherein the suspension comprises folded and symmetrical cantilevers.

6. The capacitive microphone according to claim 1, wherein the first electrical conductor comprises a first set of comb fingers, wherein the movable membrane comprises a second set of comb fingers around the peripheral region of the membrane, and wherein the two sets of comb fingers are interleaved into each other.

7. The capacitive microphone according to claim 6, wherein the second set of comb fingers are laterally movable relative to the first set of comb fingers, and the resistance from air located within a gap between the membrane and the substrate is lowered.

8. The capacitive microphone according to claim 6, wherein the first set of comb fingers and the second set of comb fingers have identical shape and dimension.

9. The capacitive microphone according to claim 8, wherein each comb finger has a same width measured along the primary direction, and the first set of comb fingers and the second set of comb fingers have a positional shift along the primary direction.

10. The capacitive microphone according to claim 9, wherein the positional shift along the primary direction is one third of said width.

11. The capacitive microphone according to claim 1, wherein the movable membrane is square shaped.

12. The capacitive microphone according to claim 11, which comprises one or more said movable membranes.

13. The capacitive microphone according to claim 12, which comprises four movable membranes arranged in a 2×2 array configuration.

14. The capacitive microphone according to claim 1, wherein the air flow restrictor decreases the size of an air channel for the air to flow in/out of the gap between the membrane and the substrate.

15. The capacitive microphone according to claim 1, wherein the air flow restrictor increases the length of an air channel for the air to flow in/out of the gap between the membrane and the substrate.

16. The capacitive microphone according to claim 1, further comprising at least two air flow restrictors that restrict the flow rate of air that flows in/out of the gap between the membrane and the substrate.

* * * * *